US005941553A

United States Patent [19]

Korman

[11] Patent Number: 5,941,553

[45] Date of Patent: Aug. 24, 1999

[54] BOOT BINDING APPARATUS FOR A SNOWBOARD

[76] Inventor: Nathan M. Korman, 6003½ Winans Dr., Los Angeles, Calif. 90068

[21] Appl. No.: 08/931,099

[22] Filed: Sep. 15, 1997

[51] Int. Cl.[6] ..... A63C 9/08

[52] U.S. Cl. ..... 280/613; 20/617; 20/14.2

[58] Field of Search ..... 280/617, 14.2, 280/613, 631, 615; 36/117

[56] References Cited

U.S. PATENT DOCUMENTS

| | | | |
|---|---|---|---|
| 2,693,967 | 11/1954 | Jones, Jr. | 280/613 |
| 3,061,325 | 10/1962 | Glass | 280/613 |
| 3,992,037 | 11/1976 | Frechin | 280/613 |
| 4,177,584 | 12/1979 | Beyl | 280/613 X |
| 4,418,937 | 12/1983 | Salomon | 280/613 |
| 4,728,115 | 3/1988 | Pozzobon et al. | 280/613 |
| 4,964,649 | 10/1990 | Chamberlain | 280/618 |
| 4,973,073 | 11/1990 | Raines et al. | 280/624 |
| 5,020,823 | 6/1991 | Bogner | 280/617 |
| 5,116,074 | 5/1992 | Peyre | 280/617 |
| 5,143,396 | 9/1992 | Shaanan et al. | 280/607 |
| 5,310,206 | 5/1994 | Eugler et al. | 280/615 |
| 5,348,335 | 9/1994 | Dasarmaux et al. | 280/633 |
| 5,362,087 | 11/1994 | Agid | 280/611 |
| 5,394,627 | 3/1995 | Eugler | 36/117 |
| 5,401,041 | 3/1995 | Jespersen | 280/14.2 |
| 5,413,372 | 5/1995 | Evans et al. | 280/620 |
| 5,474,322 | 12/1995 | Perkins et al. | 280/613 |
| 5,503,414 | 4/1996 | Teeter et al. | 280/14.2 |
| 5,505,477 | 4/1996 | Turner et al. | 280/613 |
| 5,505,478 | 4/1996 | Napoliello | 280/618 |
| 5,520,406 | 5/1996 | Anderson et al. | 280/624 |
| 5,544,509 | 8/1996 | Mielonen | 70/366 |
| 5,544,909 | 8/1996 | Laughlin et al. | 280/617 |
| 5,564,719 | 10/1996 | Kisselmann | 280/14.2 |
| 5,577,756 | 11/1996 | Caron | 280/617 |
| 5,577,757 | 11/1996 | Riepl et al. | 280/617 |
| 5,595,396 | 1/1997 | Bourdeau | 280/613 |
| 5,660,410 | 8/1997 | Alden | 280/14.2 X |
| 5,669,630 | 9/1997 | Perkins et al. | 280/613 |
| 5,671,941 | 9/1997 | Girard | 280/613 |
| 5,697,631 | 12/1997 | Ratzek et al. | 280/613 |
| 5,722,680 | 3/1998 | Dodge | 280/14.2 |

*Primary Examiner*—Daniel G. DePumpo
*Assistant Examiner*—Michael Mar
*Attorney, Agent, or Firm*—Jack C. Munro

[57] ABSTRACT

A boot binding apparatus for a snowboard in the form of a locking system where there is utilized a toe latching mechanism and a heel latching mechanism. The toe latching mechanism is to be engageable with a hook mounted either on the snowboard or embedded within the sole of the boot. The heel latching mechanism is to be engageable with the heel latching post mounted on the snowboard or within the sole of the boot. Locking engagement between the boot and the snowboard is to be accomplished by merely performing a "step-in" procedure by the rider of the snowboard. The secure locking of the boot to the snowboard is to be accomplished with the user initially engaging the toe area of the boot, or the user initially engaging the heel area of the boot, or the user engaging both the toe and the heel area simultaneously. The disengagement of the locking system is to be manually accomplished by exerting a pulling force on a lanyard with the rider in a standing position thereby permitting the boot to be separated from the snowboard.

13 Claims, 10 Drawing Sheets

BOOT BINDING APPARATUS FOR A SNOWBOARD

BACKGROUND OF THE INVENTION

1) Field of the Invention

The field of this invention relates to recreational equipment, and more particularly to a boot binding for a snowboard which is designed to be maneuvered by a human across snow.

2) Description of the Prior Art

Snowboarding is a snow sport. It constitutes a human rider placing himself or herself on the snowboard and then riding to the snowboard on downhill terrain in a manner similar to skiing. The snowboard is shorter and wider than a snow ski, and whereas skiing uses two separate members, one for each foot, the rider utilizes only a single board. The mode of operation of the snowboard is for the rider to stand on the board and instead of the rider's feet pointing forward, the rider's feet face to the side. It is necessary that the rider's feet are to be bound to the board. As opposed to conventional skiing where ski bindings are designed to release the bindings of the foot from the ski in the event that the skier falls, the board remains with the rider if the rider falls when using a snowboard.

In conjunction with skis, "step-in" bindings are well known. Such "step-in" bindings enable the skier to rapidly bind his or her booted feet to his or her skis, as well as release the ski boots from the skis at the end of a ski run while the skier is in the standing position. Within the prior art of snowboards, snowboard bindings have been of complex construction and required several separate steps in order to secure the binding to the boot of the snowboarder. During a day's activity of a snowboarder, the snowboarder must separate his or her boots from the board a plurality of times to accomplish such activities as walking, partaking of refreshments, using of restroom facilities and so forth. It is common for a snowboarder when entering a ski lift to disengage one foot from the snowboard. This removed foot from the snowboard then acts as a pushing device to propel the snowboarder to arrive at the location to gain entrance to the ski lift. At the top of the hill, the snowboarder reengages his or her foot with the snowboard after exiting the ski lift. Within the prior art, the binding procedure for the snowboarder's boot is not easily accomplished.

SUMMARY OF THE INVENTION

One of the primary objectives of the present invention is to construct a simple boot binding apparatus for a snowboard that will enable the rider to quickly detach either bound foot as needed, while leaving the other foot bound to the snowboard.

Another objective of the present invention is to construct a boot binding apparatus for a snowboard which permits the rider to quickly reattach the free boot to the snowboard when desired.

Another objective of the present invention is to construct a boot binding apparatus for a snowboard that will keep the rider's feet bound to the snowboard even during a fall.

Another objective of the present invention is to construct a boot binding apparatus for a snowboard that will enable the rider to step into the binding while remaining standing, securing the snowboard to the rider without having the rider bend over or require aid of an assistant.

Another objective of the present invention is to construct a boot binding apparatus for a snowboard that will permit the rider to disengage the boot binding apparatus while standing, thereby eliminating the need to bend over to activate any type of disengaging structure.

Another objective of the present invention is to construct a boot binding apparatus for a snowboard which will permit the rider to engage with the snowboard in three different manners, the first manner being heel-then-toe, the second manner being toe-then-heel, and the third manner being heel and toe simultaneously.

Another objective of the present invention is that by allowing the rider to engage in three different ways makes it engageable on flat surfaces or on any sloping terrain regardless of direction of slope.

Another objective of the present invention is to construct a boot binding apparatus for a snowboard where the structure that is mounted in conjunction with the boot is totally embedded within the sole of the boot thereby permitting the boot to be used in the walking manner when the boot is disengaged from the snowboard.

The boot binding apparatus of the present invention constitutes a heel latching mechanism and a hook that are mounted in a spaced apart manner on a snowboard. Mounted within the sole of the boot and totally embedded within the sole is a toe latching mechanism and a heel latching post. The heel latching mechanism and hook could be embedded within the sole and the snowboard could include the toe latching mechanism and heel latching post. The heel latching post is to engage with the heel latching mechanism. The toe latching mechanism is to engage with the hook. The heel latching mechanism includes a pawl which is to be movable from a locking position and an unlocking position. The pawl can be moved to the unlocking position by operation of a lanyard which is to be pulled by the rider while in a standing upright position. The pawl can also be moved to the unlatching position by forcing the heel latching post into engagement with the heel latching mechanism. The toe latching mechanism includes a pivotable bar which is biased to a latching position. Forcing of the toe latching mechanism in connection with the hook will result in the bar being pivoted to a release position and upon the toe latching mechanism being completely engaged with the hook, the bar will then pivot to the latching position which will secure together the hook and the toe latching mechanism.

DETAILED DESCRIPTION OF THE PREFERRED EMBODIMENT

Figures 1A, 1B, 2:
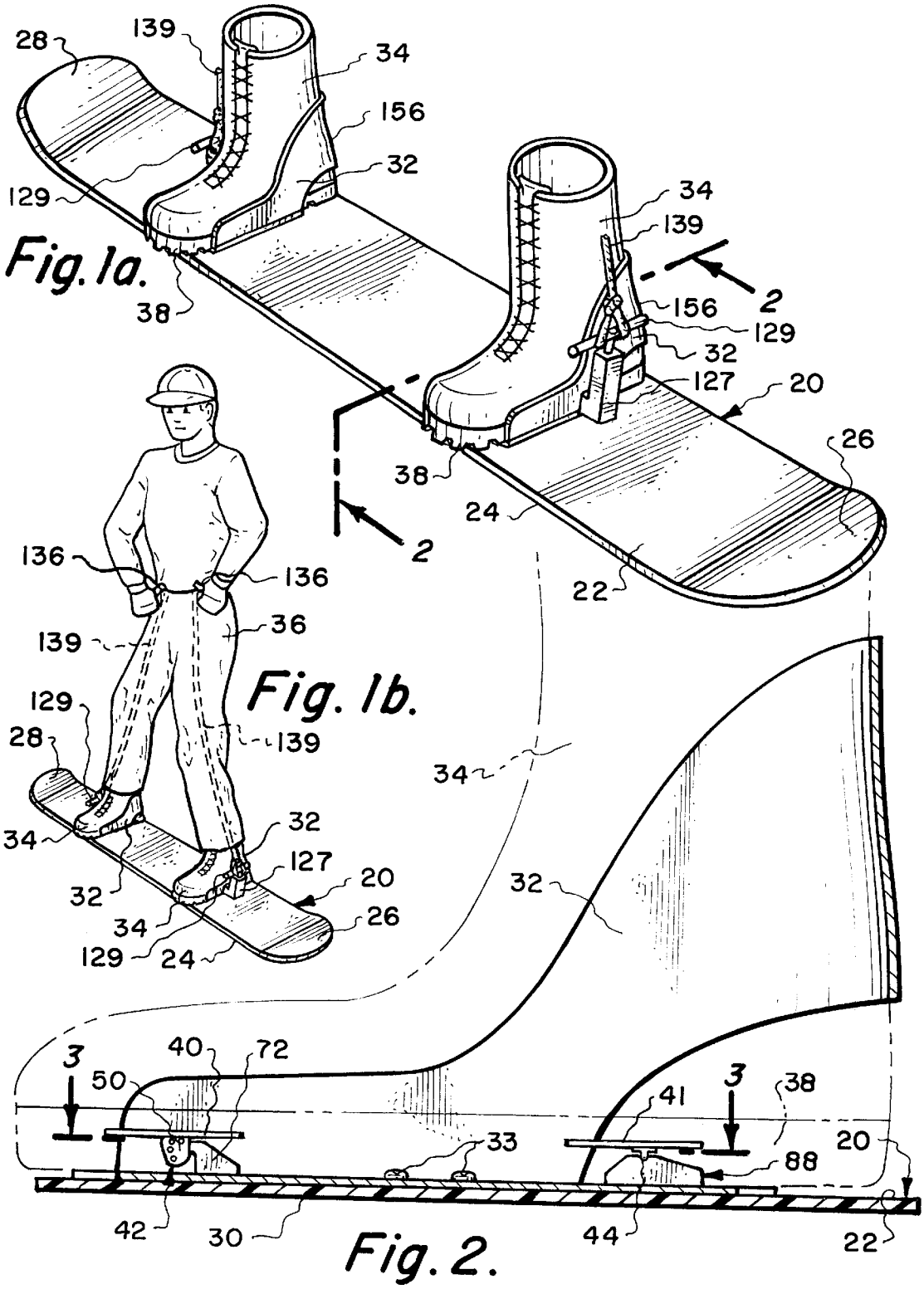
FIG. 1*a* is an isometric view showing a pair of boots being mounted with the binding apparatus of the present invention on a snowboard.
FIG. 1*b* is an isometric view depicting the rider being located on the snowboard showing the lanyard arrangement that can be used by the rider in a standing position to disengage the binding apparatus and permit the rider to step free of the snowboard.
FIG. 2 is a longitudinal cross-sectional view through one of the boots and the binding apparatus of the present invention taken along line 2—2 of FIG. 1*a;*
Figure 3:
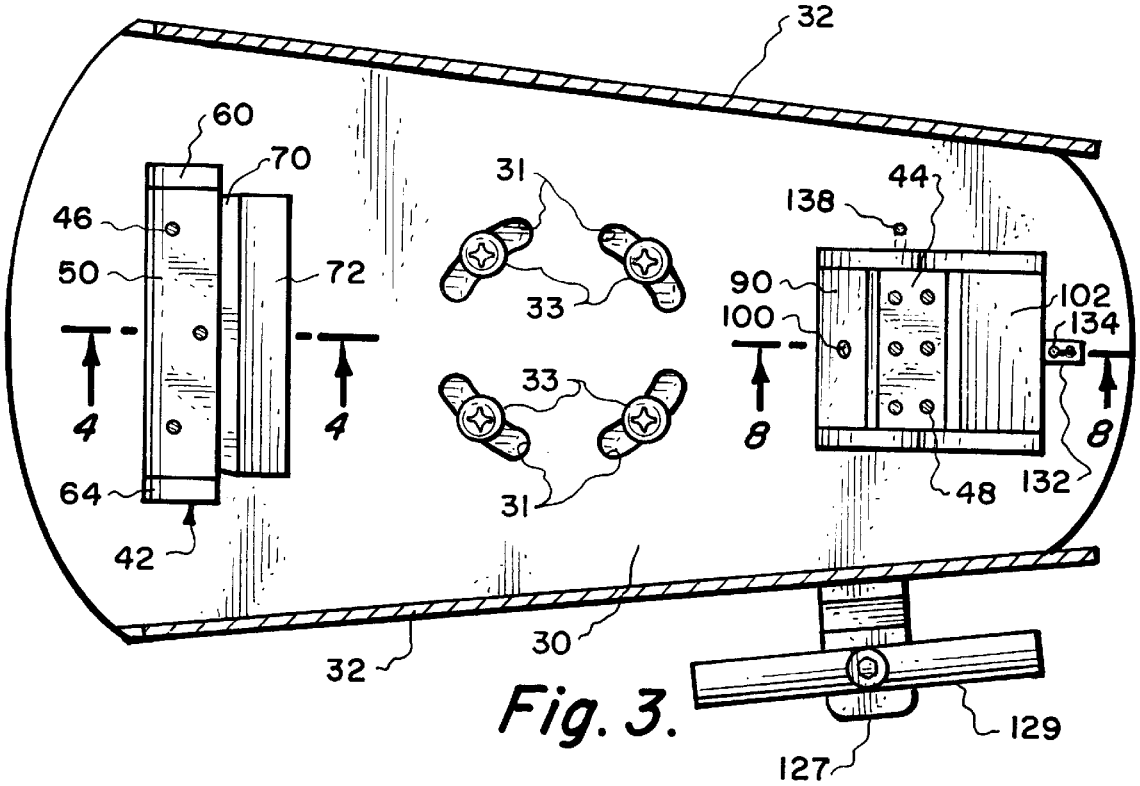
FIG. 3 is a top plan view of the mechanism that is mounted within the boot that is used in conjunction with the binding apparatus that is mounted on the snowboard taken along line 3—3 of FIG. 2.

Referring particularly to FIG. 1*a* and 1*b* of the drawings, there is shown a snowboard 20 which is basically planer having an upper surface 22, a bottom surface 24 and having an upturned front end 26 and an upturned rear end 28. The snowboard 20 will normally be constructed of wood or synthetic material. Also, it is very common that the snowboard 20 be constructed of a plurality of laminated layers of material. The mounting plate 30, usually constructed of metal or plastic, is to be mounted across the width of the snowboard 20 with there being two in number of the mounting plates 30 located in a spaced-apart manner. Each mounting plate 30 is basically identical and includes a boot support frame 32. Each boot support frame 32 is basically U-shaped and is to provide rear support for the back end of each boot 34. It is to be understood that there are two in number of the boots 34 with there being one boot 34 for the right foot and the other boot 34 for the left foot of the rider 36 of the snowboard 20. It is the function of the boot support frame 32 to provide rear support for the ankle that is associated with each boot 34. It is the purpose of each boot support frame 32 to control the degree of ankle movement.

Each of the boots 34 has a rubber or plastic type sole 38. Embedded in a fixed manner within the sole 38 is a front support plate 40 and a rear support plate 41. The front support plate 40 and the rear support plate 41 are each thin and would normally be constructed of metal. A typical thickness for the support plates 40 and 41 would be about one-eighth inch. Fixedly mounted on the front support plate 40 is a toe latching mechanism 42. A heel latching post 44 is mounted on rear support plate 41. Toe latching mechanism 42 is mounted by bolt fasteners 46 to the plate 40. The heel latching post 44 is fixedly mounted by bolt fasteners 48 to the plate 40.

Figure 4:
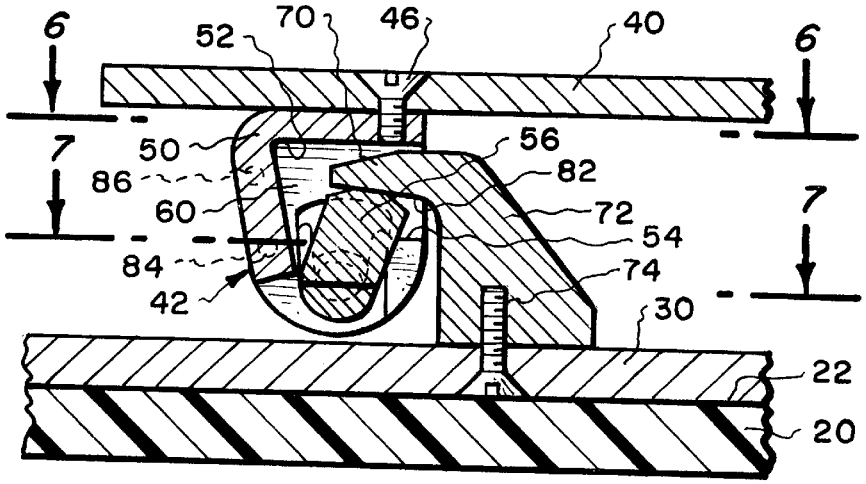
FIG. 4 is a longitudinal cross-sectional view through the toe latching mechanism of the binding apparatus of the present invention taken along line 4—4 of FIG. 3 showing the toe latching mechanism in the latched position.

The toe latching mechanism 42 comprises a U-shaped hook bar 50. The U-shaped hook bar 50 includes an internal cavity 52 with there being an access opening 54 formed through the U-shaped hook bar 50 to gain access into the internal cavity 52. Mounted within the internal cavity 52 is a bar 56. The bar 56 is mounted at one end by means of a pivot pin 58 to a block 60. The block 60 is fixedly attached to the elongated plate 40. In a similar manner, the opposite end of the bar 56 is pivotly mounted by a pivot pin 62 within a block 64. Block 64 is also integrally connected to the plate 40. Associated with the pivot pin 58 is a single coil spring 66. In a similar manner, a single coil spring 68 is connected with the pivot pin 62. The coil springs 66 and 68 function to exert a continuous bias on the bar 56 tending to locate such in a position shown in FIG. 4. When in the position of FIG. 4, forward end 70 of a hook 72 is locatable within the internal cavity 52 with the forward end 70 resting on the bar 56. The hook 72 is mounted by fasteners 74 to the mounting plate 30. The hook 72 resting on bar 56 will prevent upward disengaging movement of the elongated plate 40 and its boot 34 relative to the snowboard 20. One longitudinal end of the hook bar 50 is fixedly secured to the block 60 by means of a pair of pins 76. In a similar manner, the opposite end of the hook bar 50 is fixedly secured to the block 64 by means of a pair of pins 78. Other pins, not shown but represented by dotted lines 84 and 86, are to also further secure the hook bar 50 to block 60. Similar pins (not shown) will be used to secure hook bar 50 to block 64.

Figure 5:
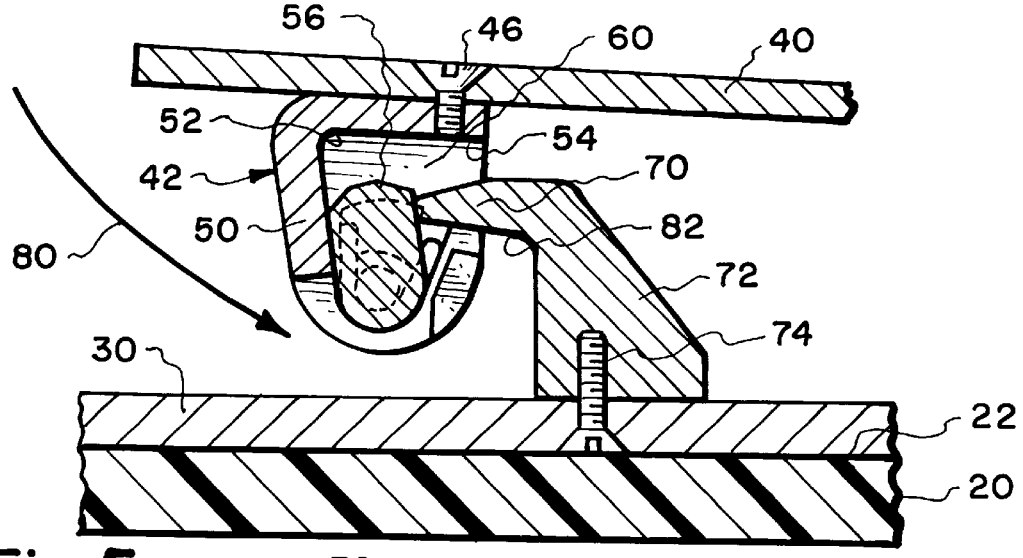
FIG. 5 is a view similar to FIG. 4 but showing the toe latching mechanism that is mounted on the boot in an intermediate position prior to complete engagement with the snowboard.
Figure 6:
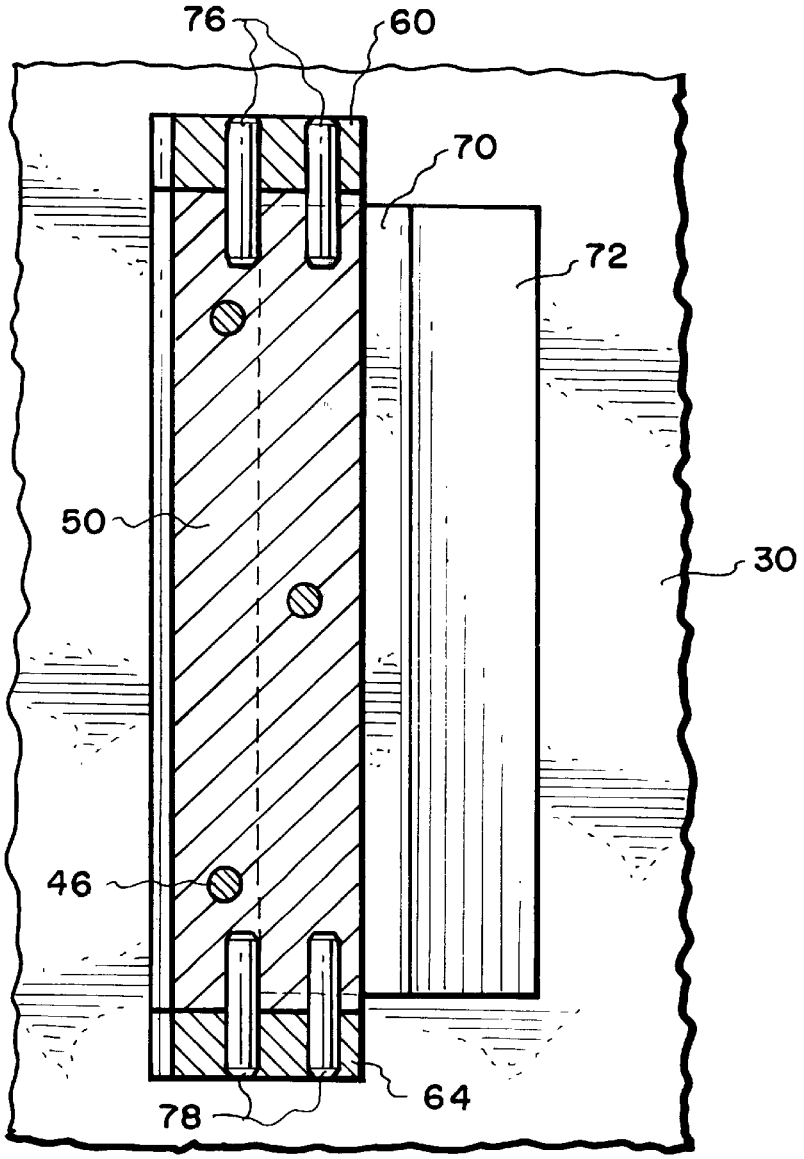
FIG. 6 is a top plan view, partly in cross-section, of the toe latching mechanism included within this invention taken along line 6—6 of FIG. 4.
Figure 7:
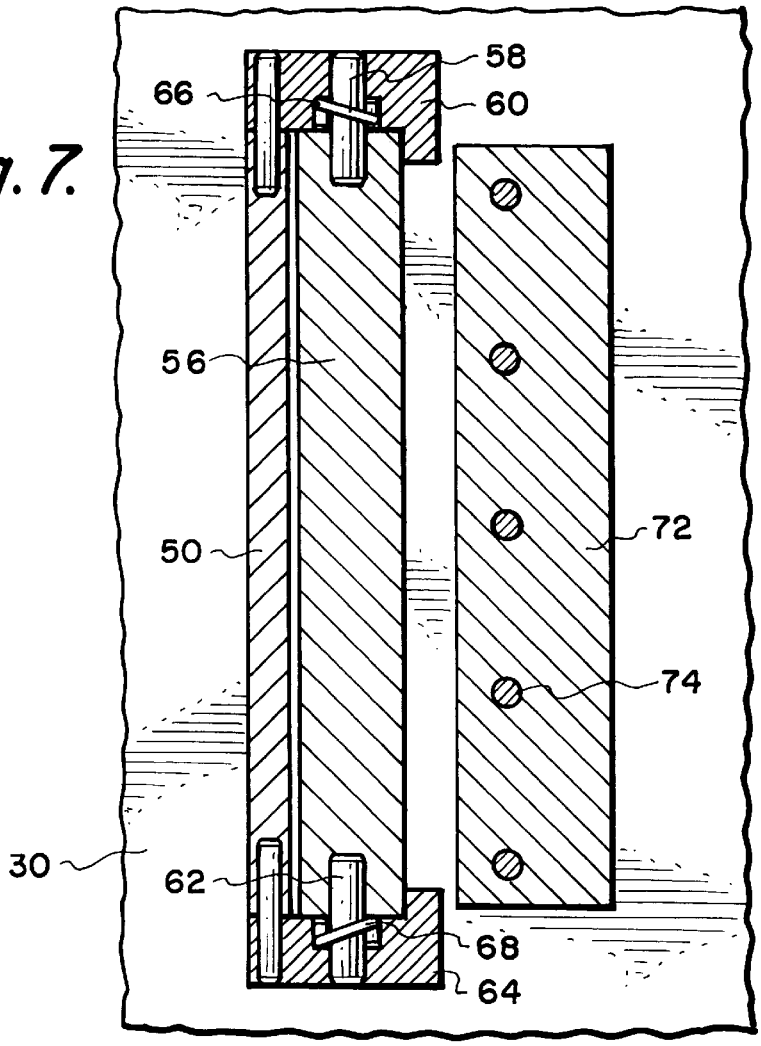
FIG. 7 is a cross-sectional view through the toe latching mechanism included within the boot binding apparatus of the present invention taken along line 7—7 of FIG. 4.

When making the engagement of the toe latching mechanism 42 with the hook 72, during the initial engaging motion depicted by arrow 80, the forward end 70 of the hook 72 will come into contact with the sidewall of the bar 56. This will cause the bar 56 to pivot in a rearward direction against the bias of the springs 66 and 68. When the forward end 70 passes the sidewall of the bar 56, the bias of the springs 66 and 68 will cause the bar 56 to pivot with the bar 56 being located against the undersurface 82 of the forward end 70. This is referred to as the latching position shown in FIG. 4. The release position is shown in FIG. 5.

Mounted on and partially within the mounting plate 30 is a heel latching mechanism 88. The heel latching mechanism includes a fixed member 90 which is fixed by pins 92 to the mounting plate 30. The fixed member 90 has a front surface 94. With the heel latching post 44 in engagement with the heel latching mechanism 88, the heel latching post 44 is to abut against the front surface 94. Included within the front surface 94 is a resilient pad 96. The pad 96 is mounted on a block 98. A threaded fastener 100 is to connect with the block 98. The purpose of the fastener 100 is that it can be tightened or loosened relative to the fixed member 90 to either cause extension or retraction of the resilient pad 96 relative to the front surface 94. The position of the resilient pad 96 is to remove any looseness in the connection between the heel latching post 44 and the heel latching mechanism 88 so that there is a snug interconnection in between such when in the latched position, as shown in FIG. 8.

Figure 8:
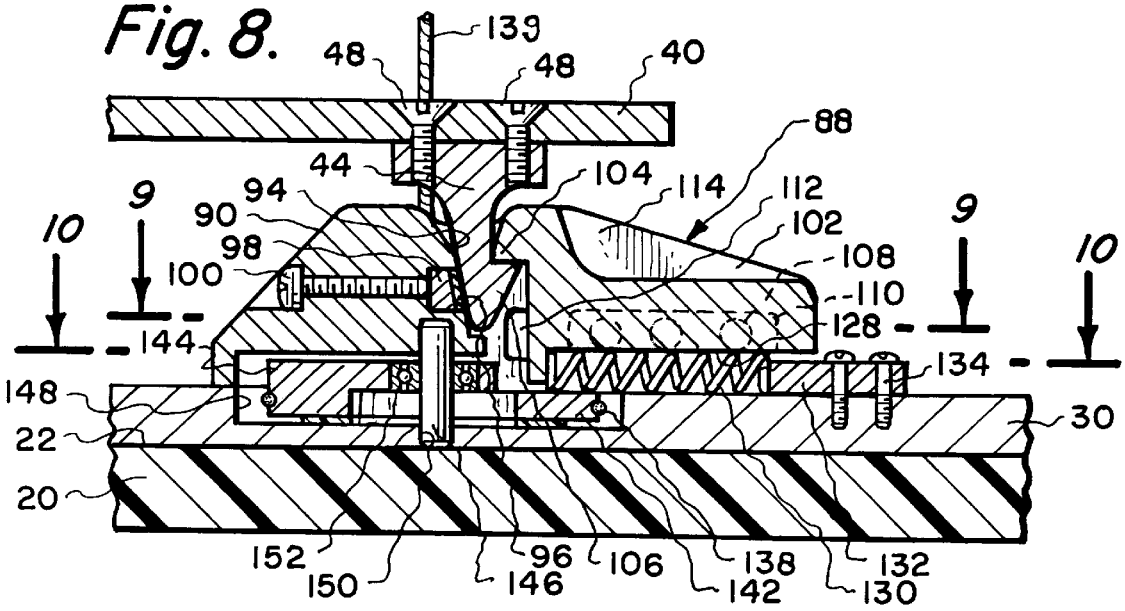
FIG. 8 is a longitudinal cross-sectional view through the heel latching mechanism included within the boot binding apparatus of the present invention taken along line 8—8 of FIG. 3 showing the heel latching mechanism in the locking position.
Figure 9:
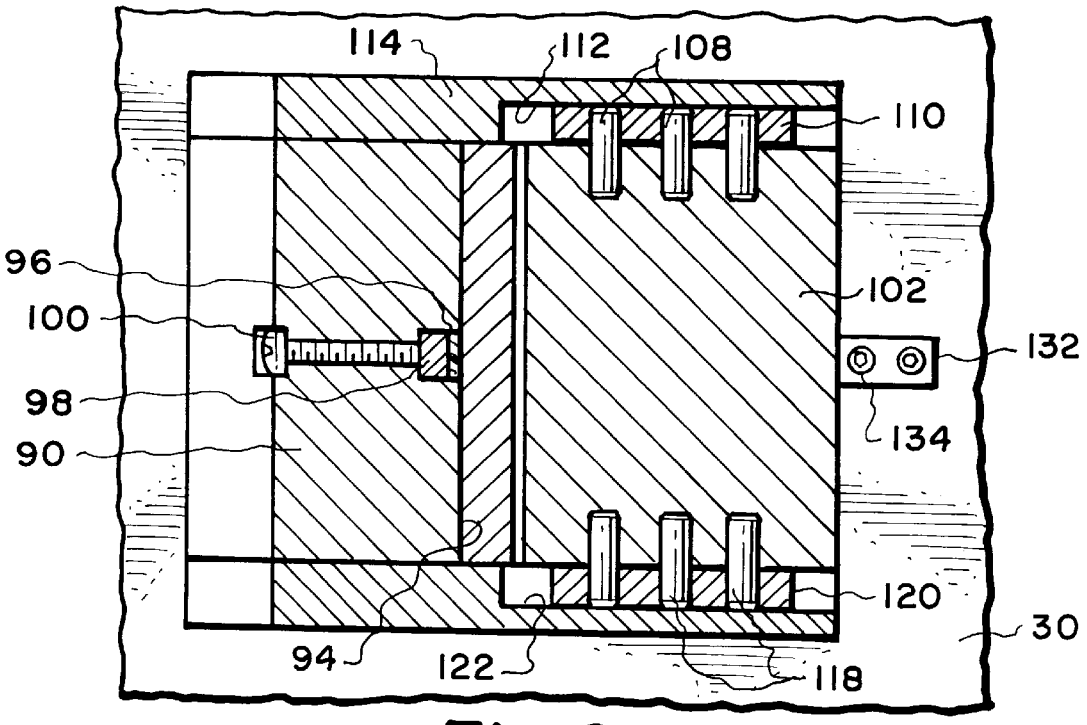
FIG. 9 is a cross-sectional view through the heel latching mechanism included within the boot binding apparatus taken along line 9—9 of FIG. 8.

When in the latched position shown in FIG. 8, the heel latching mechanism 88 has a pawl 102 which includes a hook 104 which is in engagement with the hook 106 of the heel latching post 44. Therefore, vertical movement of the elongated plate 40 is thereby prevented which secures the boot 40 to the snowboard 20. Pawl 102 is fixedly mounted by pins 108 to a sliding block 110. Sliding block 110 is movably mounted within a longitudinal cut-out 112. The longitudinal cut-out 112 is formed within block 114 which is fixedly secured by pins 116 to the plate 30.

The opposite side edge of the pawl 102 is fixedly mounted by pins 118 to a sliding block 120. Sliding block 130 is mounted within a longitudinal cut-out 122 which is formed within a block 124 which is fixedly mounted by pins 126 to the mounting plate 130. The amount of movement of the sliding blocks 110 and 120 is of course limited by the longitudinal lengths of their respective cut-outs 112 and 122. The length of the cut-outs 112 and 122 is selected so that the pawl 102 can be moved between the locking position shown in FIG. 8 and the unlocking position shown in FIG. 11. Pawl 102 includes an internal cavity 128. Within the cavity 128 is mounted a coil spring 130. The inner end of the coil spring 130 abuts against the pawl 102 with the rear end of the coil spring 130 abutting against the block 132. Block 132 is fixedly mounted by fasteners 134 to the mounting plate 30. The coil spring 130 exerts an continuous bias against the pawl 102 tending to locate such in the locking position shown in FIG. 8. However, the pawl 102 can be moved against the bias of the spring 130 to the unlocking position shown in FIG. 11 which will permit the heel latching post 44 to be disengaged from the heel latching mechanism 88.

The pawl 102 can be manually moved against the bias of coil spring 130 by the rider grasping onto T-shaped handle 129 and pulling upwardly. Handle 129 is mounted within a block 127 which is fixed to boot support frame 32. There is a coil spring (not shown) mounted within block 127 which tends to locate the handle in the lower or non-extended position.

Figure 11:
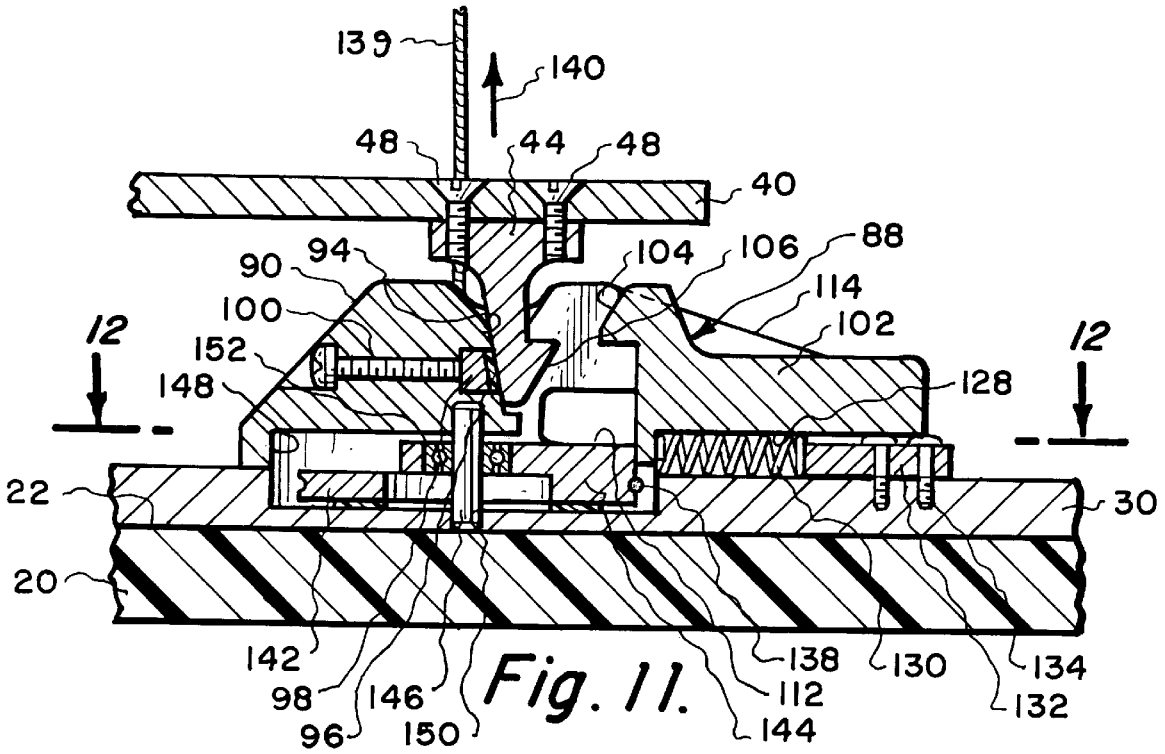
FIG. 11 is a view similar to FIG. 8 but showing the heel latching mechanism included within the boot binding apparatus in the unlocking position.
Figure 12:
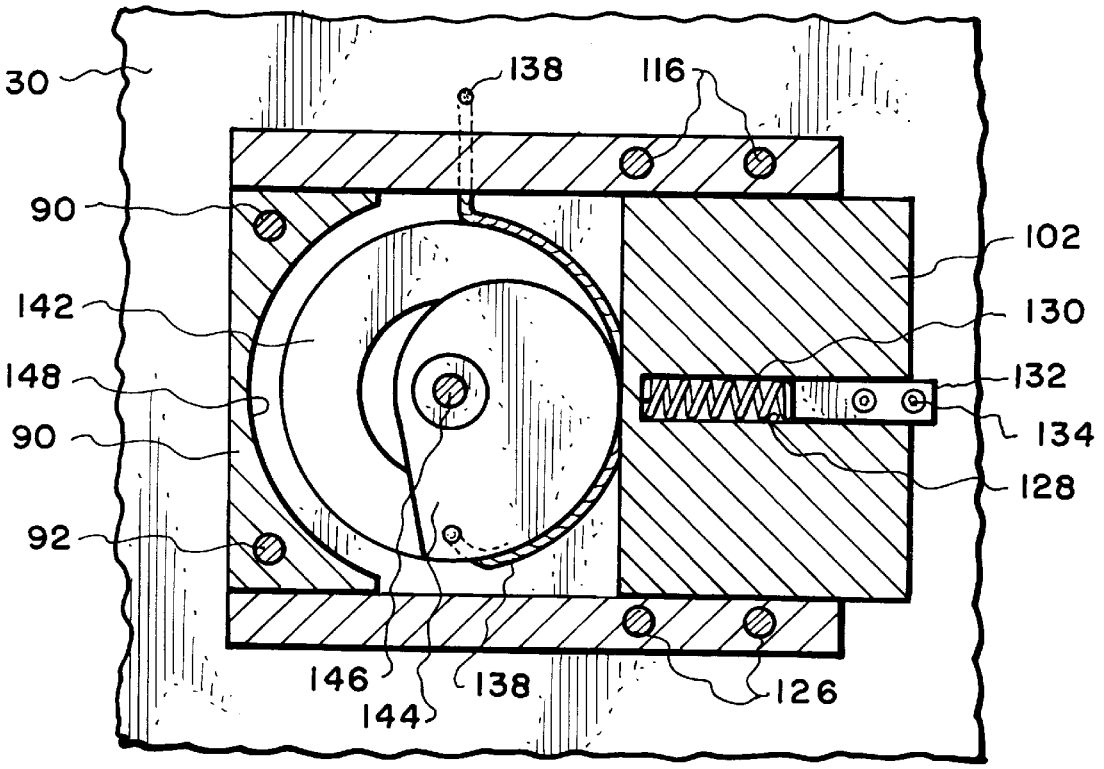
FIG. 12 is a cross-sectional view taken along line 12—12 of FIG. 11.

In order to disconnect the boot 34 from the snowboard 20, it is necessary that the pawl 102 be moved to the unlocking position shown in FIG. 11. In order to move the pawl 102, the rider is to manually grasp outer end 136 of lanyard 139, which could be mounted directly adjacent the rider's waist, as shown in FIG. 1*b,* and exert a pulling movement on the outer end 136. This will cause the lanyard 139 to be pulled. It is to be understood that there is a separate outer end 136 for each boot binding and also a separate lanyard 139 for each boot binding. The pulling force of the lanyard 139 is represented by arrow 140. The lower end of each lanyard 139 is tied to a handle 129. From handle 129 there is a cable 138 which is wrapped around a pulley 142. The pulley 142 includes a raised cam section 144. The pulley 142 and the raised cam section 144 are pivotally mounted by pivot pin 146 to the fixed member 90. The pulley 142 is mounted within a recess 148 formed within the mounting plate 30. A pivot pin 146 is mounted within a hole 150 also formed within the mounting plate 30. Mounted about the pivot pin 146 is a bearing 152. The raised cam section 144 is mounted about the bearing 152.

Figure 10:
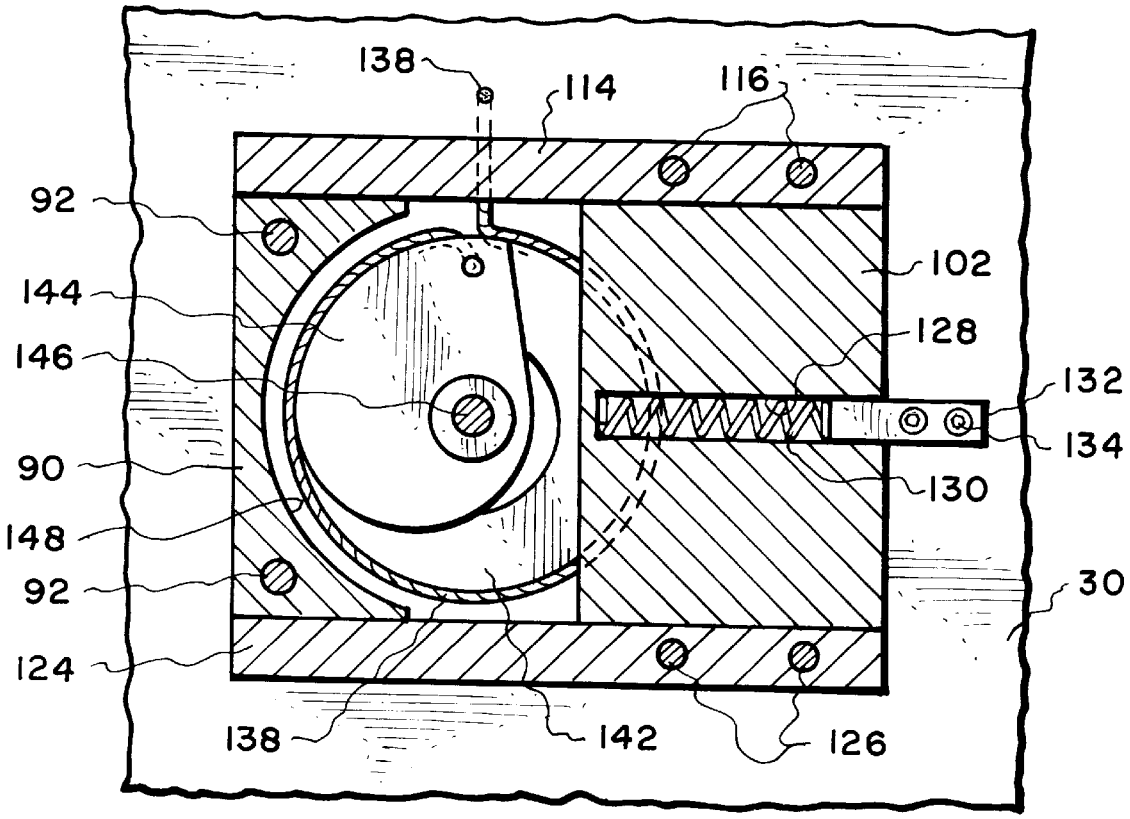
FIG. 10 is a cross-sectional view through the heel latching mechanism included within the boot binding apparatus taken along line 10—10 of FIG. 8.

When the lanyard 139 is not extended and handle 129 is in the lower position, as shown in FIG. 10, the raised cam section 144 is located spaced from the pawl 102. However, upon extension of the lanyard 139 a sufficient amount, the handle 129 is extended and raised cam section 144 is pivoted by movement of cable 138 and comes into contact with the forward surface of the pawl 102. Further pivoting movement of the raised cam section 144 then results in the pawl 102 being pushed from the locking position shown in FIG. 8 to the unlocking position shown in FIG. 11. It is to be noted that the pulley 142 rides underneath the pawl 102 and only the raised cam section 104 comes into contact with the pawl 102 which is eccentric relative to the rotational axis of the pivot pin 146.

Each of the lanyards 139 may be connected to their respective T-shaped handle 129 by a separate disengageable quick disconnect mechanism (not shown). Normally the quick disconnect mechanism 154 is disconnected when the rider 36 installs his or her feet into the boots 34. After the feet have been installed, then the lanyard 139 is connected by the disconnect mechanism. One form of quick disconnect mechanism would be a buckle assembly. The lanyard 139 can be located inside of the rider's trousers or outside of the rider's trousers.

The boot support frame 32 is to normally include a high back support plate 156. A substantial area of support is required for the rider, especially when initiating a heel side turn. In order to accomplish this, the rider has to lean rearwardly, and when doing that rearward leaning, a substantial area of contact is desired. It is for this reason that the high back 156 is included within the boot support frame 32. The boot support frame 32 could be mounted within the boot 34 rather than separate from boot 34.

It is to be reiterated that one of the primary advantages of the present invention is that the rider can lockingly engage his or her boots 34 with the snowboard 20 by merely "stepping into" the binding mechanism which comprises the toe latching mechanism 42 and hook 72, and the heel latching post 44 and the heel latching mechanism 88. The rider can "step in" toe first, heel first or the toe and the heel simultaneously. Previously such snowboard mounting apparatuses allowed only one type of installation with it generally being required to be toe first.

The mounting plate 30 is adjustably mounted on the snowboard 20. This adjustment is provided by holes arcuately shaped elongated (four in number) 31 each of which engage with a fastener 33. There are four in number of fasteners 33. Each fastener 33 is fastened to snowboard 20. Each fastener 33 has an enlarged head. The holes 31 are arranged in a generally circular pattern. When the fasteners 33 are loosened, the mounting plate 30 can be pivoted relative to snowboard 20 thereby providing adjustment of the position of the mounting plate 30 relative to the snowboard 20. This adjustment is to provide for an individual's preference in the position of the mounting plate 30 and hence the boot 34. When the desired position is obtained, the fasteners 33 are tightened to fix the mounting plate 30 to the snowboard 20. It is to be understood that both mounting plates 30 are to include this adjustment.

Figure 13:
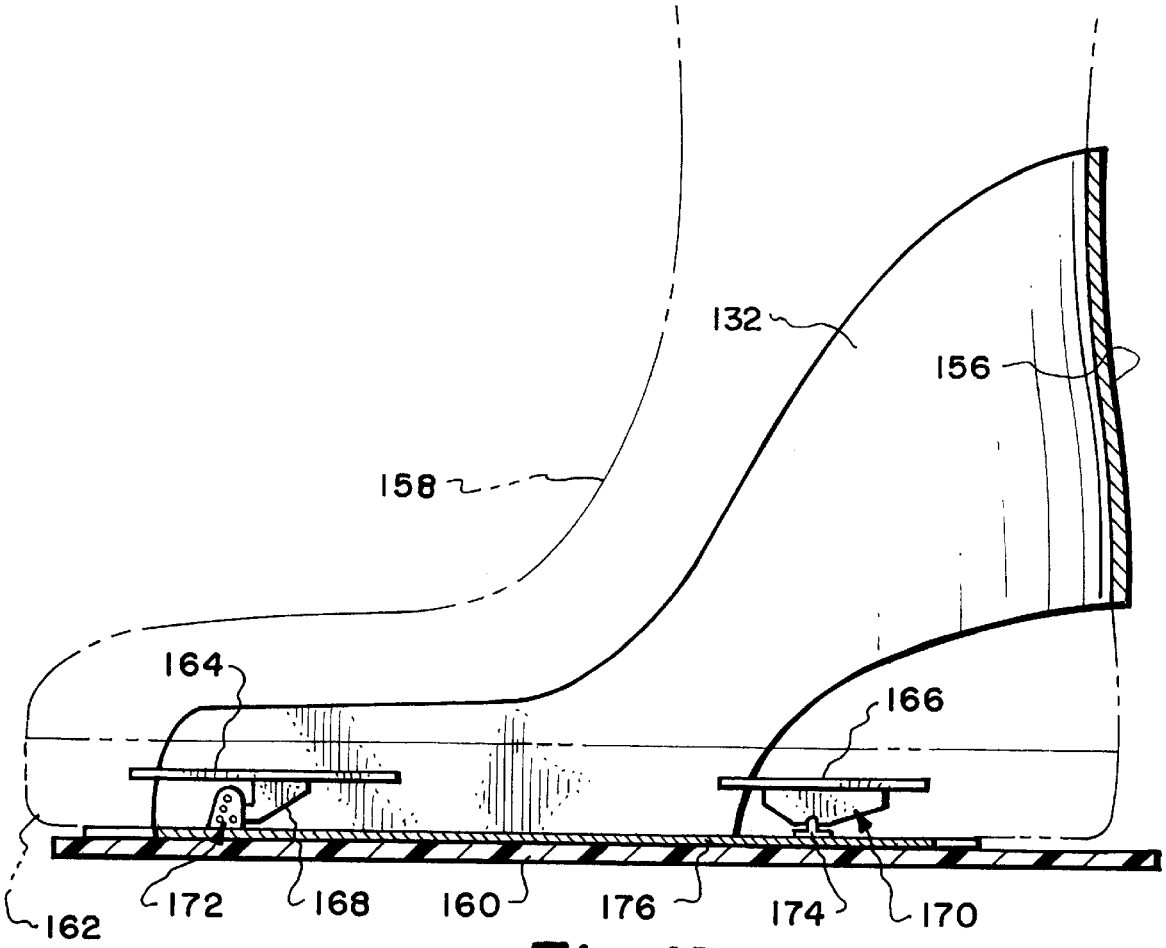
FIG. 13 is a view similar to FIG. 2 but showing the mountings of the mechanism reversed between the snowboard and the boot.

Referring particularly to FIG. 13, there is shown a modification of this invention where the parts are reversed between the boot 158 and the snowboard 160. Imbedded within the sole 162 of the boot 158 is a front support plate 164 and a rear support plate 166. Mounted on the front support plate 164 is a hook 168 which is similar to hook 72. Mounted on the rear support plate 166 is a heel latching mechanism 170 which is similar to heel latching mechanism 88. Mounted on the snowboard 160 is a toe latching mechanism 172 which is to latchingly engage with the hook 168. Also mounted on the snowboard 160 is a heel latching post 174 which is to engage with heel latching mechanism 170. The engagement of boot 158 with the snowboard 160 is to be in the same manner as engagement between boot 34 and snowboard 20. Heel latching post 174 and toe latching mechanism 172 are fixedly mounted on base plate 176 which is fixed to snowboard 160. Also, only the hook 168 and the toe latching mechanism 172 could be reversed leaving the heel latching mechanism 170 and heel latching post 174 not reversed (as shown in FIG. 2). Further, the hook 168 and the toe latching mechanism 172 could not be reversed and the heel latching mechanism 170 and heel latching post 174 are reversed.

Figure 14:
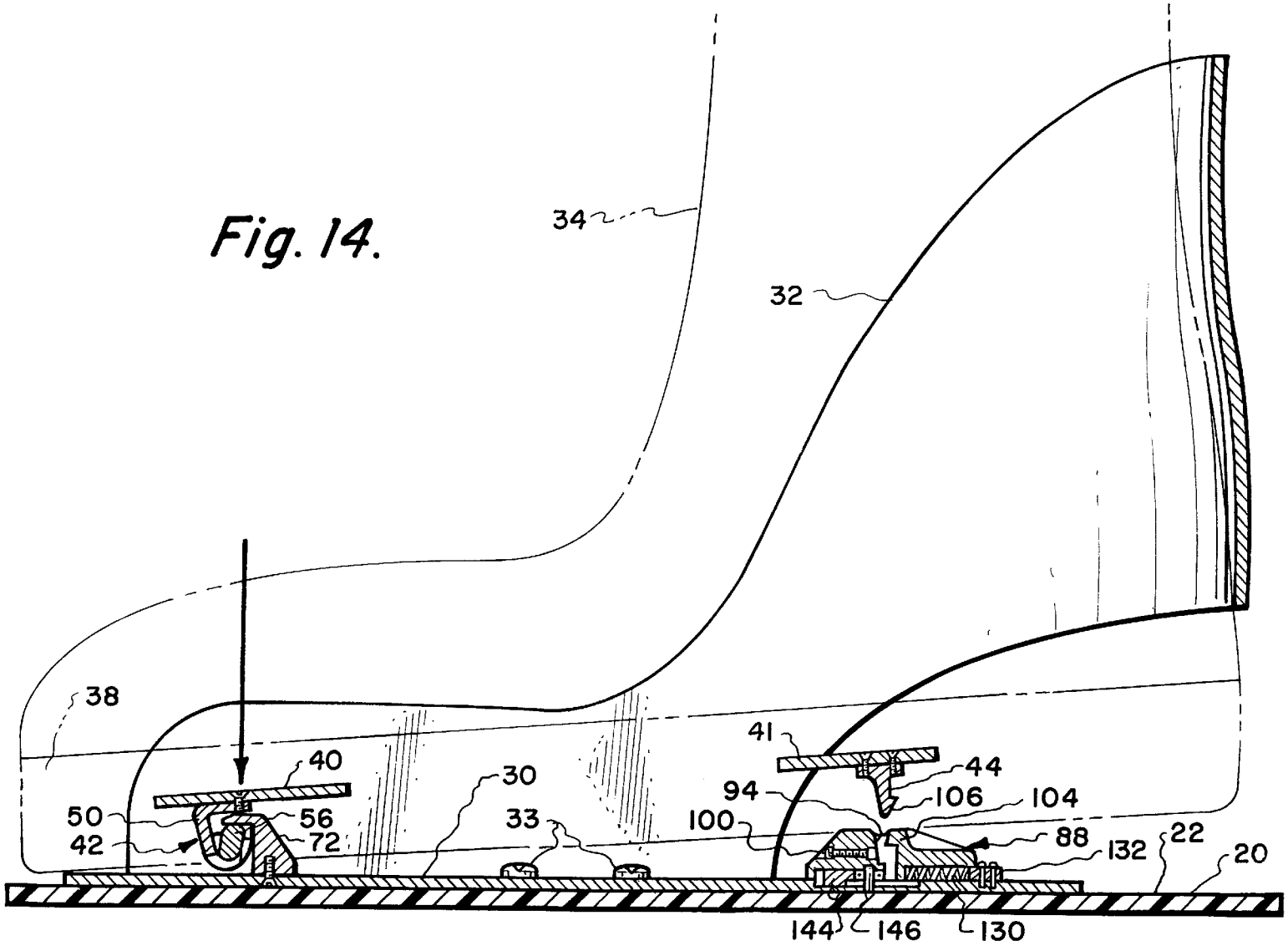
FIG. 14 is a longitudinal cross-sectional view through the binding apparatus of this invention depicting engagement of the boot with the toe of the boot engaging first and then the heel.
Figure 15:
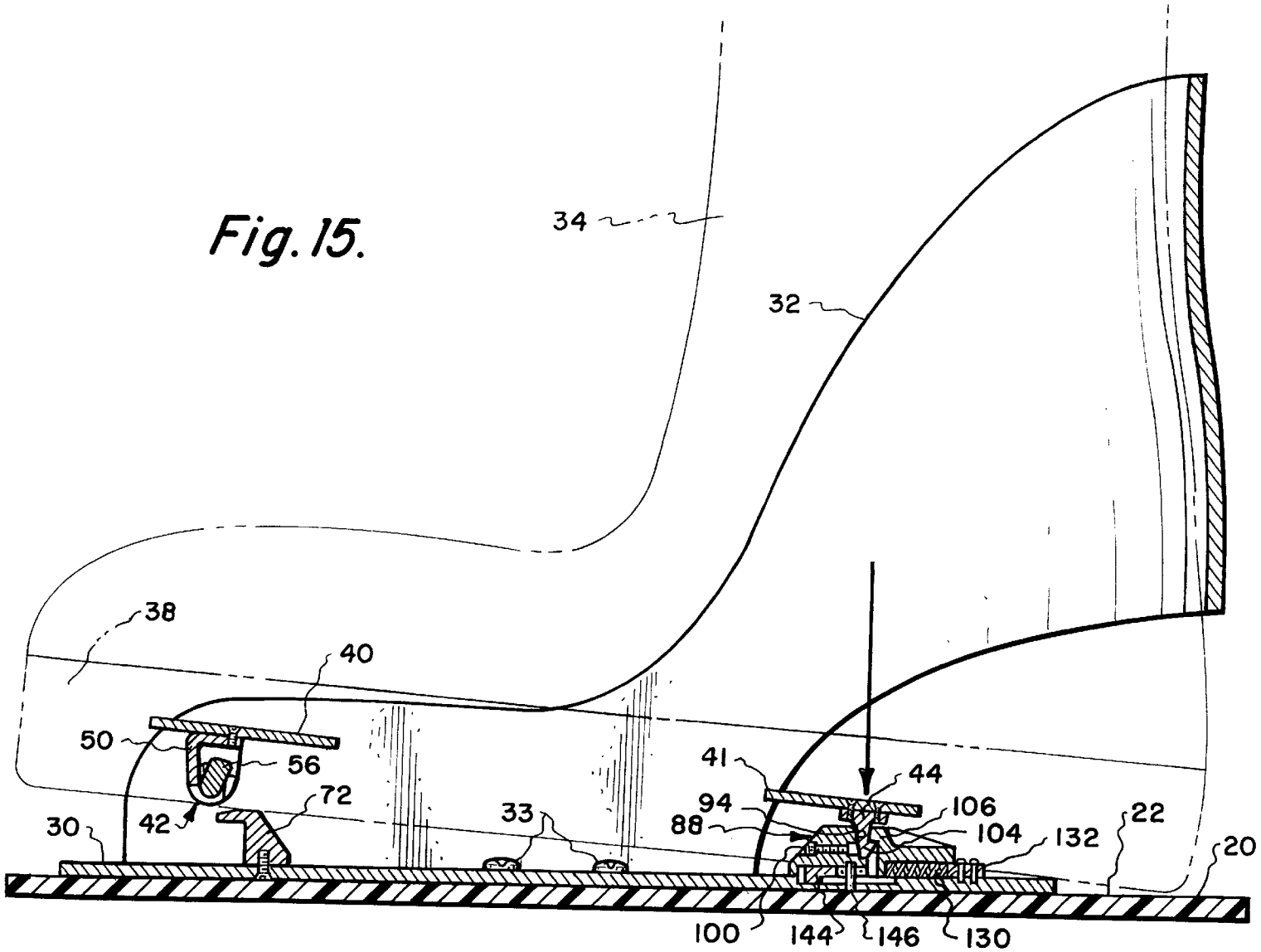
FIG. 15 is a view similar to FIG. 14 but depicting engagement with the binding apparatus with the heel engaging first and then the toe.
Figure 16:
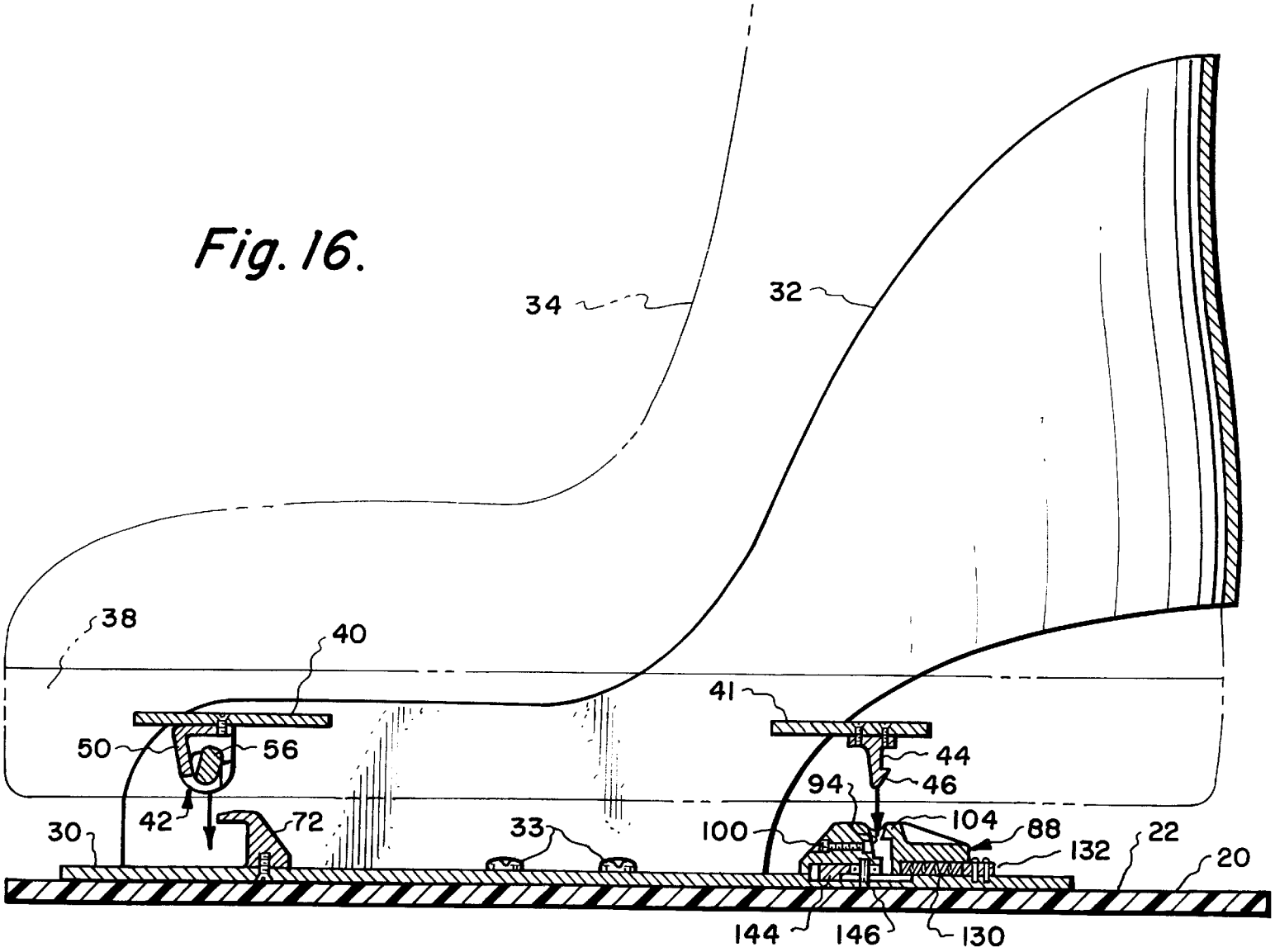
FIG. 16 is a view similar to FIG. 15 but depicting engagement with the binding apparatus with both the heel and toe engaging simultaneously.

Referring particularly to FIG. 14, there is depicted the snowboard binding apparatus of the present invention with the engaging procedure being with the toe of the boot engaging first, that is the toe latching mechanism 42 engaging with the hook 72 and then engagement occurring between the heel latching post 44 and the heel latching mechanism 88. Referring particularly to FIG. 15, there is shown an optional engaging procedure which the rider can utilize and that being with initial engagement occurring between the heel latching post 44 and the heel latching mechanism 88 and then latching to occur between the toe latching mechanism 42 and the hook 72. Still further, the rider can partake of another type of engagement procedure which is depicted in FIG. 16. This engagement procedure is with the toe latching mechanism 42 engaging with the hook 72 and the heel latching mechanism 88 engaging with the heel latching post 44 simultaneously. This will give the rider three different engagement modes not limiting the rider to a single engagement mode which is common within prior art types of snowboard binding apparatuses.

What is claimed:

1. A boot binding apparatus for a rider of a snowboard comprising:

a snowboard boot having a sole, said sole having an exterior surface adapted to come in contact with terrain when the rider is walking and disengaged from the snowboard, said sole having a toe latching mechanism and a downwardly extending, rigid heel latching post, paid toe latching mechanism being spaced from said heel latching post, said toe latching mechanism having a movable bar, both said toe latching mechanism and said heel latching post being totally embedded within said sole so no part of said toe latching mechanism and said heel latching post protrudes exteriorly of a lowermost surface of said sole although access to said toe latching mechanism and said heel latching post is obtained from said exterior surface; and a toe hook and a heel latching mechanism mounted on said snowboard, said toe hook adapted to removably engage with said movable bar, said heel latching mechanism to removably engage with said heel latching post, said heel latching mechanism including a pawl, said pawl being movable between a locking position and an unlocking position, said locking position to be capable of lockingly restraining said heel latching post, said unlocking position permitting movement of said heel latching post into and out of engagement with said heel latching mechanism, said pawl being continuously biased toward said locking position.

2. The boot binding apparatus as defined in claim 1 wherein:

said pawl being lineally movable between said locking position and said unlocking position.

3. The boot binding apparatus as defined in claim 1 wherein:

said pawl includes a first cam surface, said first cam surface to be contactable by said heel latching post during interengagement of said heel latching post with said heel latching mechanism which will result in said pawl being moved from said locking position to said unlocking position.

4. A boot binding apparatus for a rider of a snowboard comprising:

a snowboard boot having a sole, said sole having an exterior surface adapted to come in contact with terrain when the rider is walking and disengaged from the snowboard, said sole having a toe latching mechanism and a heel latching post, said toe latching mechanism being spaced from said heel latching post, both said toe latching mechanism and said heel latching post being embedded within said sole;

a heel latching mechanism mounted on said snowboard, said heel latching mechanism to removably engage with said heel latching post, said heel latching mechanism including a pawl, said pawl being movable between a locking position and an unlocking position, said locking position to be capable of lockingly restraining said heel latching post, said unlocking position permitting movement of said heel latching post into and out of engagement with said heel latching mechanism, said pawl being continuously biased toward said locking position; and a hook mounted on said snowboard, said hook to removably engage with said toe latching mechanism, said toe latching mechanism including a bar, said bar being pivotable between a latching position and a release position during engaging movement of said boot with said snowboard and as said heel latching mechanism is engaged with said heel latching post, said bar is pivoted to said release position as said toe latching mechanism is engaged with said hook, upon complete engagement occurring between said toe latching mechanism and said hook where upon said bar pivots to said latching position thereby securing said boot to said snowboard.

5. The boot binding apparatus as defined in claim 4 wherein:

said boot including a second cam surface, said second cam surface being contactable by said heel latching mechanism during moving of said heel latching mechanism into engagement with said heel latching post.

6. The boot binding apparatus as defined in claim 4 wherein:

said bar being continuously spring biased to said latching position.

7. A boot binding system apparatus for a rider of a snowboard comprising:

a snowboard boot having a sole, said sole having an exterior surface adapted to come into contact with terrain when the rider in walking and disengaged from the snowboard, said sole having a toe hook and a heel latching mechanism, said toe hook being spaced from said heel latching mechanism, both said toe hook and said heel latching mechanism being totally embedded within said sole so no part of said toe hook and said heel latching mechanism protrudes exteriorly of a lowermost surface of said sole although access to said toe hook and said heel latching mechanism is obtained from said exterior surface;

a heel latching post mounted on said snowboard, said heel latching post to removably engage with said heel latching mechanism, said heel latching mechanism including a pawl, said pawl being movable between a locking position and an unlocking position, said locking position to be capable of lockingly restraining said heel latching post, said unlocking position permitting movement of said heel latching mechanism into and out of engagement with said heel latching post, paid pawl being continuously biased toward said locking position; and a toe latching mechanism mounted on said snowboard, said toe latching mechanism including a bar removably engageable with said toe hook, said bar being pivotable between a latching position and a release position during engaging movement of said boot with said snowboard as said heel latching mechanism is engaged with said heel latching post, said bar being pivoted to said release position as said toe latching mechanism is engaged with said toe hook, upon complete engagement occurring between said toe latching mechanism and said toe hook whereupon said bar pivots to said latching position thereby securing said boot to said snowboard.

8. The boot binding apparatus as defined in claim 7 wherein:

said pawl being lineally movable between said locking position and said unlocking position.

9. The boot binding apparatus as defined in claim 7 wherein:

said pawl including a first cam surface, said first cam surface to be contactable by said heel latching post during engagement of said heel latching post with said heel mechanism which will result in said pawl being moved from said locking position to said unlocking position.

10. The boot binding apparatus as defined in claim 7 wherein:

said bar being continuously spring biased to said latching position.

11. A boot binding apparatus for a rider of a snowboard comprising:

a snowboard boot having a sole, said sole having an exterior surface adapted to come in contact with terrain when the rider is walking and disengaged from the snowboard, said sole having a hook and a heel latching post, said hook being spaced from said heel latching post, both said hook and said heel latching post being totally embedded within said sole so no part of said hook and said heel latching post protrudes exteriorly of a lowermost surface of said sole although access to said hook and said heel latching post is obtained through said exterior surface;

a heel latching mechanism mounted on said snowboard, said heel latching mechanism to removably engage with said heel latching post, said heel latching mechanism including a pawl, said pawl being movable between a locking position and an unlocking position, said locking position to be capable of lockingly restraining said heel latching post, said unlocking position permitting movement of said heel latching post into and out of engagement with said heel latching mechanism, said pawl being continuously biased toward said locking position; and a toe latching mechanism mounted on said snowboard, said toe latching mechanism to removably engage with said hook, said toe latching mechanism including a bar, said bar being pivotable between a latching position and a release position during engaging movement of said boot with said snowboard and as said heel latching mechanism is engaged with said heel latching post, said bar is pivoted to said release position as said toe latching mechanism is engaged with said hook, upon complete engagement occurring between said toe latching mechanism and said hook whereupon said bar pivots to said latching position thereby securing said boot to said snowboard.

12. A boot binding apparatus for a rider of a snowboard comprising:

a snowboard boot having a toe portion, a heel portion, and a sole with a bottom opening recess formed therein, said sole having a toe latching mechanism and a downwardly extending rigid heel latching post attached to a bottom surface of the recess and fully received therein; and a toe hook and a heel latching mechanism mounted on said snowboard, said toe hook being removably attachable with said toe latching mechanism and said heel latching mechanism being removably attachable with said latching post, said heel latching mechanism including a pawl being linearly movable between a locking position and an unlocking position, said pawl being biased to the locking position in the direction of the boot toe and movable in the direction of the heel portion to the unlocking position, wherein said boot is attachable to said snowboard by first attaching either the toe latching mechanism to the toe hook or the latching post to the heel latching mechanism and then attaching the other one of the toe latching mechanism or the latching post to the toe hook or the heel latching mechanism respectively, said boot being further attachable to the snowboard by simultaneously attaching the toe latching mechanism and the latching post to the toe hook and the heel latching mechanism respectively.

13. A boot binding apparatus for a rider of a snowboard comprising:

a snowboard boot having a toe portion, a heel portion, and a sole with a bottom opening recess formed therein, said sole having a toe hook and a downwardly extending rigid heel latching post attached to a bottom surface of the recess and fully received therein; and a toe latching mechanism and a heel latching mechanism mounted on said snowboard, said toe hook being removably attachable with said toe mechanism and said heel latching mechanism being removably attachable with said latching post, said heel latching mechanism including a pawl being linearly movable between a locking position and an unlocking position, said pawl being biased to the locking position in the direction of the boot toe and movable in the direction of the heel portion to the unlocking position, wherein said boot is attachable to said snowboard by first attaching either the toe hook to the toe latching mechanism or the latching post to the heel latching mechanism and then attaching the other one of the toe hook or the latching post to the toe latching mechanism or the heel latching mechanism respectively, said boot being further attachable to the snowboard by simultaneously attaching the toe hook and the latching post to the toe latching mechanism and the heel latching mechanism respectively.

* * * * *